US005187912A

United States Patent [19]

Hsueh

[11] Patent Number: 5,187,912

[45] Date of Patent: Feb. 23, 1993

[54] PARTITION FRAME ELEMENTS

[76] Inventor: Jen S. Hsueh, No. 2-1, Lane 59, Ming Shiang Street, Chung-Ho, Taipei, Taiwan

[21] Appl. No.: 787,393

[22] Filed: Nov. 4, 1991

[30] Foreign Application Priority Data

Dec. 10, 1990 [CN] China ..... 90224774.3

[51] Int. Cl.[5] ..... E04B 1/38

[52] U.S. Cl. ..... 52/584; 52/238.1; 52/595; 52/582; 52/300; 160/351

[58] Field of Search ..... 52/238.1, 239, 584, 52/593, 595, 582, 587, 583, 220, 222, 243.1, 300, 465, 574, 738, 588, 285, 777, 778, 779, 781; 160/351, 368.1, 377

[56] References Cited

U.S. PATENT DOCUMENTS

| | | | |
|---|---|---|---|
| 1,853,090 | 4/1932 | Smiley | 52/238.1 |
| 2,015,754 | 10/1935 | Koenig et al. | 52/238.1 |
| 2,643,170 | 6/1953 | Vanderveld et al. | 52/238.1 X |
| 3,049,197 | 8/1962 | Ludwig | 52/582 |
| 3,428,108 | 2/1969 | Singer | 160/351 X |
| 3,998,024 | 12/1976 | Frandsen | 52/595 |
| 4,094,113 | 6/1978 | Good | 52/238.1 X |
| 4,455,807 | 6/1984 | Ehrlich | 52/582 X |
| 4,712,336 | 12/1987 | Backer | 160/351 X |
| 5,054,255 | 10/1991 | Maninfior | 52/582 X |

*Primary Examiner*—Richard E. Chilcot, Jr.
*Assistant Examiner*—Robert J. Canfield
*Attorney, Agent, or Firm*—Bucknam and Archer

[57] ABSTRACT

Partition frame elements, comprising base elements each of which being made through the process of extrusion and comprising an elongated flat base wall, two vertical side walls, a transverse rib spaced from said base wall, a tenon and a plurality of projecting strips longitudinally disposed on said transverse rib; and cover elements each of which comprising an elongated flat wall with an opening thereon, and two vertical side walls. By inserting the tenon of one base element into the groove between two projecting strips on another base element, two base elements are connected together and secured in place by two cover elements at two opposite ends.

4 Claims, 4 Drawing Sheets

PARTITION FRAME ELEMENTS

BACKGROUND AND SUMMARY OF THE INVENTION

The present invention relates to partition frame elements for building partition frames conveniently.

In building construction, when the framework of a building is finished, the space therein may be divided into several separate spaces or rooms for different purposes. Recently, flexible partition arrangement has been commonly applied to satisfy personal taste. However, the conventional flexible partition installation method is still not satisfactory in application. Disadvantages of conventional flexible partition installation method are numerous and outlined hereinbelow.

1. It is complicated to build up. Several working tools are used and air pollution or noise problem may occur during construction.

2. It provides poor dust-proof and poor sound-proof effects. Since hinges are commonly used to connect two partition boards together, gaps will occur between partition boards.

3. It is not stable in use. When several partition boards are connected in series, they may oscillate or deform easily after installation.

4. It requires professional workers to perform. A user can not build up a partition by himself since it requires special technique and tools to achieve.

The present invention has been accomplished to eliminate the aforesaid problems. According to the present invention, one can easily built up a partition by himself without the use of any special working tools.

DETAILED DESCRIPTION OF THE PREFERRED EMBODIMENT

Figure 1:
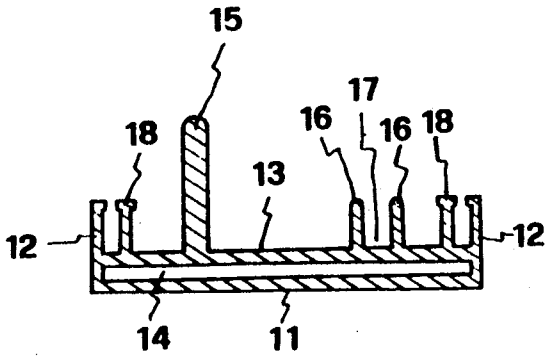
FIG. 1 is a cross section of a base element as constructed according to the present invention.

Referring to the annexed drawings in detail, the present invention comprises a base element 1 and a cover element 2. A base element 1 may be made from aluminum or any suitable rigid material through the process of extrusion and shaped like a channel bar. FIG. 1 illustrates the cross section of a base element 1 according to the present invention. As illustrated, the base element 1 comprises a base wall 11 having two vertical side walls 12 at two opposite sides and a rib 13 connected between said two vertical side walls 11 and spaced from said base wall 11 by a gap 14. The rib 13 is disposed parallel to the base wall 11, having a tenon 15 upstanding therefrom at a location adjacent to one vertical side wall and two paralleled projecting strips 16 upstanding therefrom at a location adjacent to the other vertical side wall. The two paralleled projecting strips 16 define therebetween a groove 17. The distance between the groove 17 and the adjacent vertical side wall is equal to the distance between the tenon 15 and the other vertical side wall and, the width of the groove 17 is slightly wider than the thickness of the tenon 15. There are two vertical projections 18 on the rib 13, with one disposed between the groove 17 and the adjacent vertical side wall and with the other disposed between the tenon 15 and the other vertical side wall. The two vertical projections 18 are spaced from the two vertical side walls 12 at equal distance. Further, the rib 13 and the base wall 11 have holes (not shown) aligned for fastening.

Figure 3:
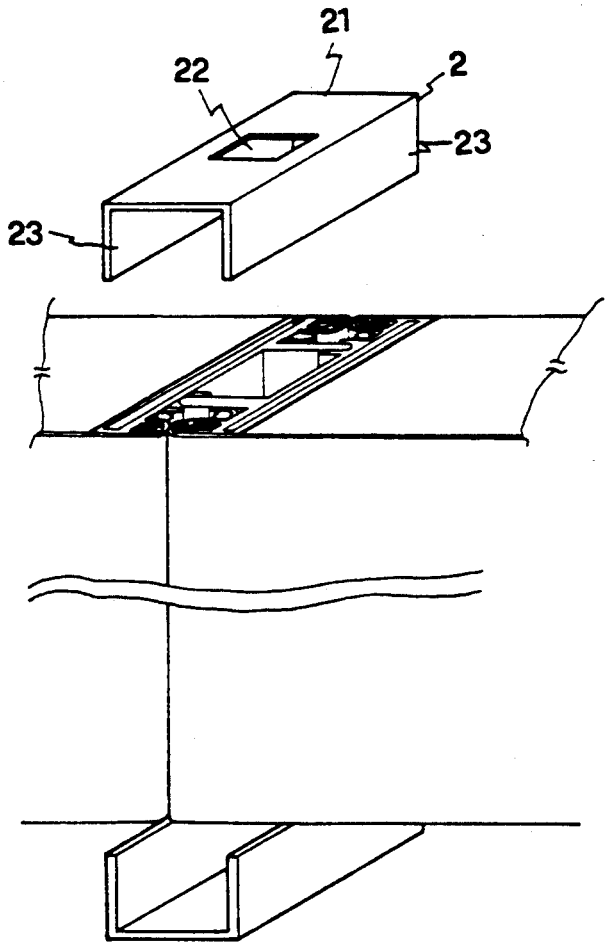
FIG. 3 is a schematic drawing showing the installation of a cover element.

Referring to FIG. 3, a cover element 2 as constructed in accordance with the present invention is made in a shape like a channel bar, having two vertical side walls 23 projecting from a base wall 21 at two opposite sides. The base wall 21 of the cover element 2 has a through-hole 22. The size of the through-hole 22 on the cover element 2 is determined according to the length of the tenon 15 and the area defined within the tenon 15 and the adjacent projection strip 16. The distance between the two vertical side walls 23 is equal to the distance between the two gaps 14 in two base elements 1 which are connected together.

Figure 2:
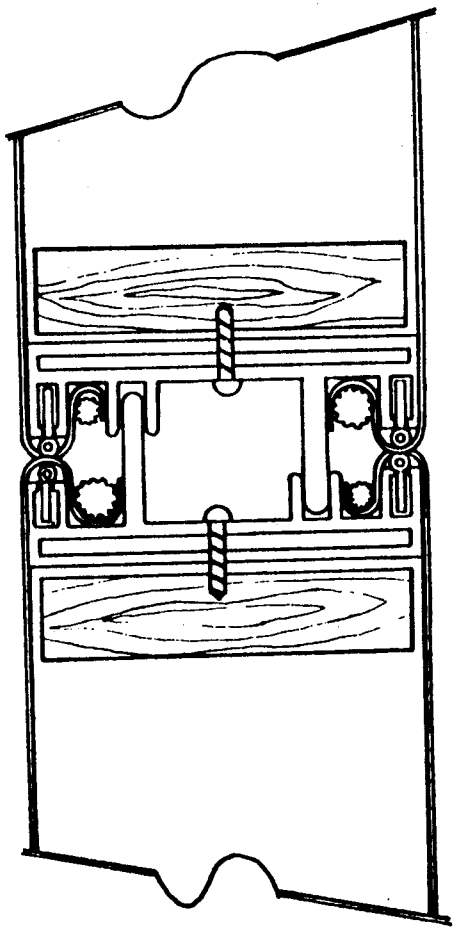
FIG. 2 is a schematic plan view showing that two base elements are respectively fastened in two separate partition wall boards and connected into a partition frame.

Referring to FIG. 2 and seeing FIG. 3 again, two base elements 1 are cut into proper length according to the height of the wall boards onto which they are to be fastened. During installation, the base wall 11 of one base element is attached to one wall board and the base wall of the other base element is attached to the another wall board and then fixedly respectively fastened in place by fastening screws through the holes on the rib 13 and the base wall 11 of either base element into corresponding holes on the corresponding wall board. Then, the two base elements 1 are connected together by inserting the tenon 15 of either base element into the groove 17 on the other base element. Once the two base elements 1 are connected together, a space is defined therein for wiring. As soon as the two base elements 1 are connected together, they may be separated from each other when they are pulled in two opposite directions. Therefore, the two opposite ends of the two base elements 1 shall be covered with a cover element 2 each by inserting the two vertical side walls 23 of each cover element 2 into the two gaps 14 on the two base elements 1 at either end.

Figure 4:
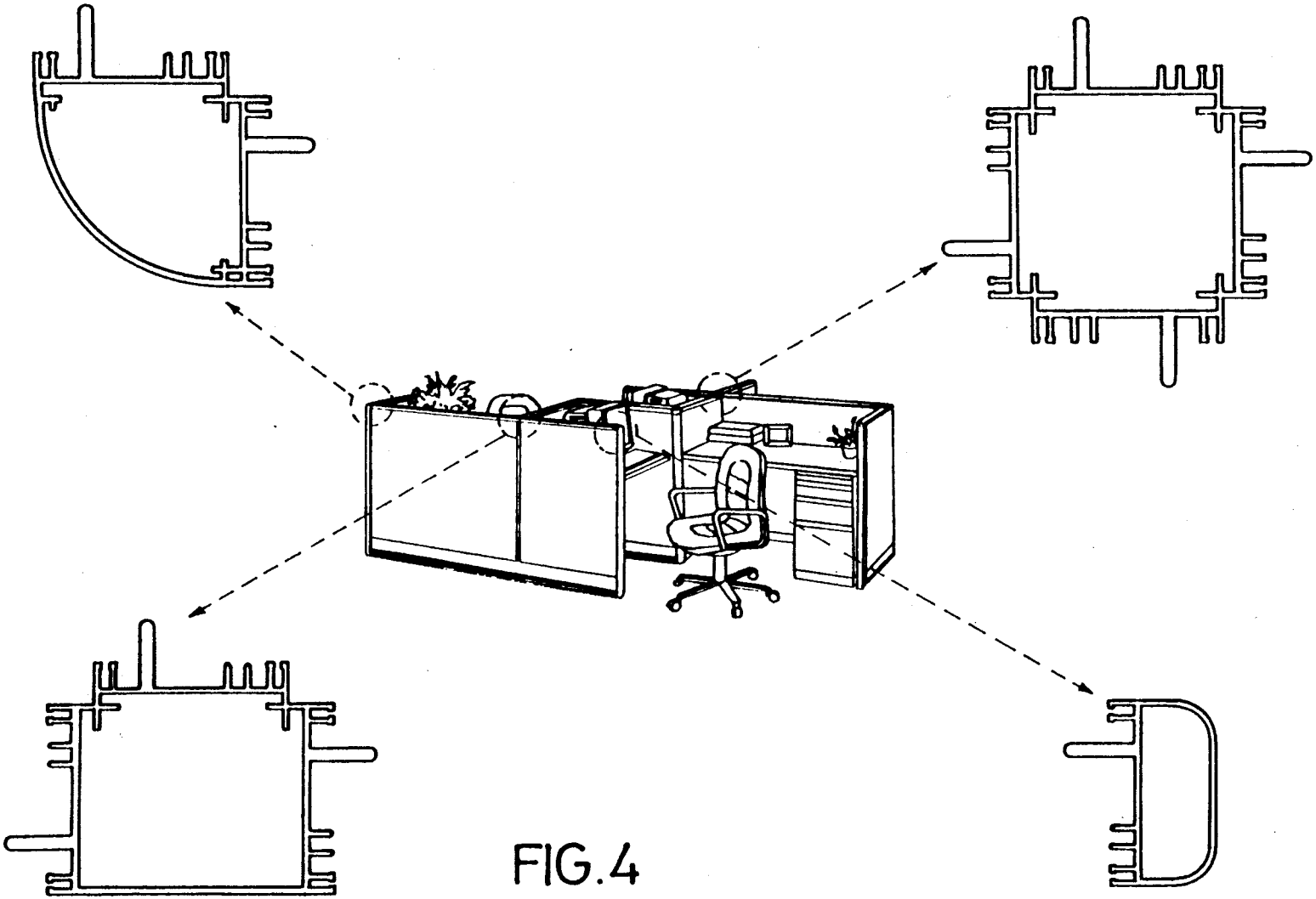
FIG. 4 is a sectional view showing an alternate form of the base element for multi-direction installation.

FIG. 4 illustrates an alternate form of the present invention for multi-direction installation. As illustrated in the drawing, the base wall 11 may be eliminated or broken for multi-direction installation.

Figure 5:
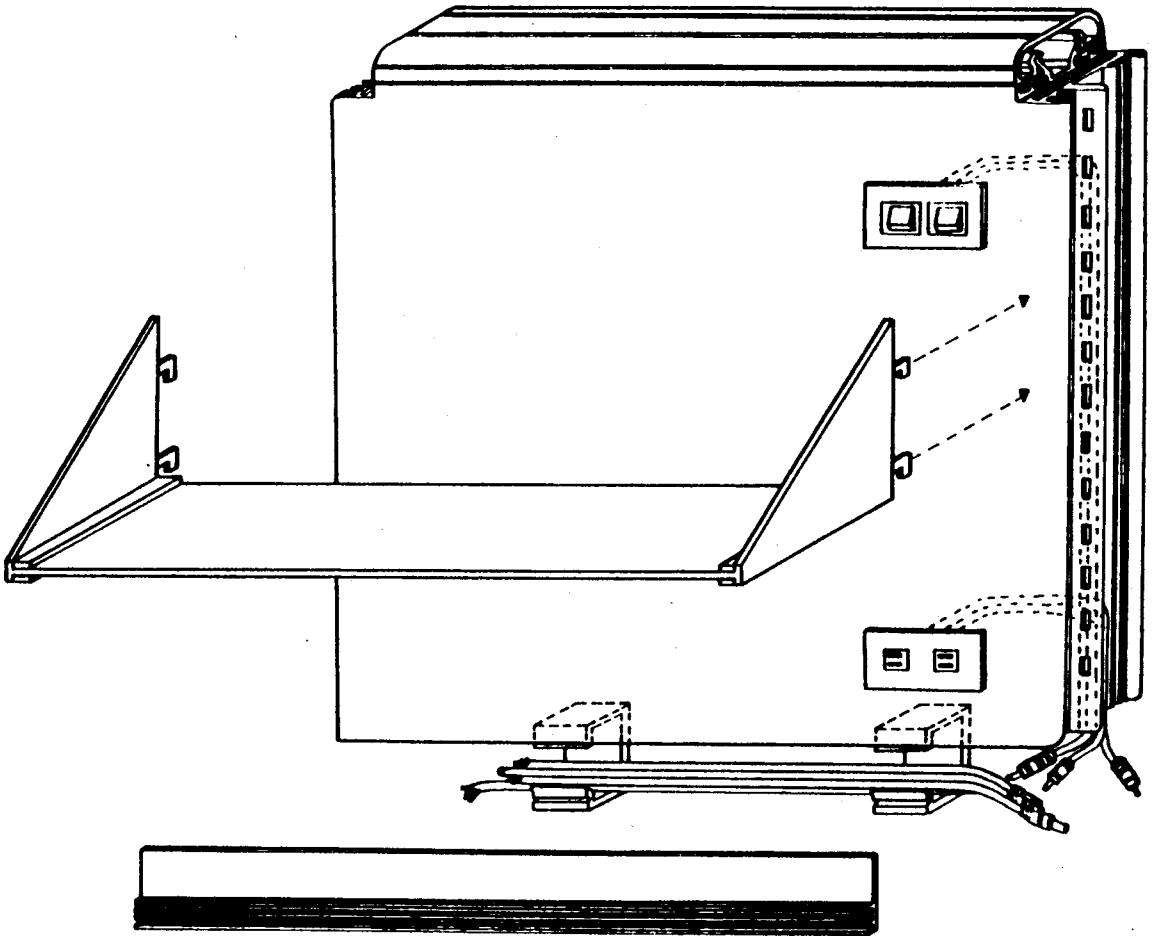
FIG. 5 illustrates an application example of the base element for fastening hangers.

Referring to FIG. 5, holes may be made on the tenon 15 for fastening hangers.

As illustrated, the present invention may be variously embodied. Recognizing that various modifications are apparent, the scope herein shall be deemed as defined in the claims hereinafter.

What is claimed is:

1. A pair of partition frame elements, each of which comprises:

a base member (1) made of an elongated shape through the process of extrusion and having a first elongated flat base wall (11), two first vertical side walls (12) upstanding from said base wall at two opposite sides, a rib (13) spaced from said base wall and transversely connected between said two vertical side walls, said rib, said first base wall and said two first vertical side walls defining therebetween a gap, a tenon (15) longitudinally connected to said rib and parallel to said two vertical side walls, and two spaced projecting strips (16) longitudinally disposed on said rib between said tenon and one vertical side wall, said two spaced projecting strips defining therebetween an elongated groove (17) in longitudinal direction, cover elements each comprising two second vertical side walls (23) projecting from a second elongated flat base member at two opposite sides, said second base member of said cover elements having an opening thereon; and wherein the frame elements of said pair are assembled together, with the tenon of either base member being inserted into the groove on the other base member, and being secured in place by two said cover elements at two opposite ends.

2. The partition frame elements of claim 1, wherein the distance between said groove and the adjacent first vertical side wall is equal to the distance between said tenon and the other first vertical side wall on the same base member.

3. The partition frame elements of claim 1, wherein said base members are integrally assembled at right angles.

4. The partition frame elements of claim 1, wherein said tenon has a plurality of holes made thereon.

* * * * *